United States Patent [19]

Morse et al.

[11] Patent Number: 4,520,751

[45] Date of Patent: Jun. 4, 1985

[54] RECEIVING BELT MECHANISM

[75] Inventors: Albert I. Morse; Douglas H. Crowell, both of Beverly; Thomas J. Gilligan, III, Danvers, all of Mass.

[73] Assignee: USM Corporation, Farmington, Conn.

[21] Appl. No.: 556,451

[22] Filed: Nov. 30, 1983

[51] Int. Cl.[3] ..... B05C 1/02

[52] U.S. Cl. ..... 118/203; 118/202; 118/260

[58] Field of Search ..... 118/104, 203, 260, 202, 118/69

[56] References Cited

U.S. PATENT DOCUMENTS

| | | | |
|---|---|---|---|
| 852,861 | 5/1907 | Webber | 118/203 |
| 3,970,038 | 7/1976 | Thettu | 118/203 X |
| 4,480,581 | 11/1984 | Simmonds, Jr. et al. | 118/202 |

*Primary Examiner*—John P. McIntosh
*Attorney, Agent, or Firm*—Donald N. Halgren

[57] ABSTRACT

A conditioning apparatus for a rotating annular belt at a powder reinforcing machine, wherein an arrangement of arms are pivotably secured to a frame portion of the machine, to scrape the belt as it intermittently rotates, to deposit a release fluid onto the width of the belt as it rotates, and to spread the fluid evenly across the belt if fluid puddles up thereon due to the intermittent nature of the belts rotation. The arm for releasing fluid onto the belt has a felt portion which receives fluid from a conduit in communication with a reservoir for the fluid. All the arms are pivotably attached to the frame portion of the machine, adjacent the annular belt, and all are lockable in an upright position to facilitate repair or replacement of any components thereof.

7 Claims, 2 Drawing Figures

RECEIVING BELT MECHANISM

BACKGROUND OF THE INVENTION

1. Field of the Invention

This invention relates to powder deposition machinery, and more particularly to a shoe machine utilizable for applying a coating of plastic material from a rotating receiving belt to a substrate.

2. Prior Art

The shoe and apparel industry have for many years been applying stiffening and reinforcing means to their shoe uppers, blue jeans, pajamas, sports clothing, and visors of caps and the like.

U.S. patent application Ser. No. 451,919, now U.S. Pat. No. 4,480,581, to Simmonds et al and assigned to the present assignee, shows a machine for applying powdered material to a substrate, wherein a powder deposition station has a stencil assembly which applies a powder onto an annular receiving belt, the powder being applied in a three-dimensional configuration because peripheral spacer means are arranged on the cutout between the stencil and the receiving belt. The annular receiving belt surface is empowered to rotate to an arcuate heating station where the powder thereon is fused by heating elements arranged thereabove and therebelow. The fused powder is then moved on the belt to a join and cool station, where a substrate such as a shoe upper or a portion of a garment is first received in a gripping arrangement on a rotatable transfer means at the join and cool station, and thereafter rotated and pressed against the fused powder by the transfer means causing it to press against a chill plate beneath the receiving belt. The substrate with the fused powder adhered thereto is then lifted by the transfer means from the receiving belt after the substrate and fused powder has cooled somewhat, the transfer means with the gripping means holding the now reinforced substrate, rotating the substrate configuration from facing the receiving belt, to enable the transfer means to present the substrate at its initial location for unloading thereof by a machine operator from the gripping arrangement on the transfer means, the receiving belt rotating so as to present a new location and configuration of fused powder thereon to the deposition station. Residue of the fused powder, however, may remain deposited on portions of the receiving belt after the fused configuration of powder has been pressed by the substrate and lifted therefrom. This may present a problem to subsequent depositions of powder which are to be deposited at the same location on the rotatable receiving belt.

It is an object of the present invention, to provide a means for conditioning the receiving belt prior to its rotation to the deposition station.

It is a further object of the present invention to provide a means for removing contamination from the receiving belt to improve the quality of the deposition at the deposition station.

BRIEF SUMMARY OF THE INVENTION

The present invention comprises a receiving belt conditioning mechanism arranged on the peripheral frame encompassing the annular receiving belt on a powder deposition machine.

The receiving belt comprises an annular web of material, suspended between an annular frame therefor, which assembly rotates within the frame of the power deposition machine so as to advance the belt intermittently through the stages of the machine, that is, through the deposition station, the heating stations, and the join and cool station, to return through the cycle, back at the deposition station, ready for a subsequent application of powder to be configured thereon.

The conditioning mechanism comprises an array of arms suspended over the belt, between the join and cool station, and the deposition station. Each arm guides an element in contact with the upper surface of the receiving belt. The first arm, pivotably connected to the frame of the machine carries a polytetraflouide scraper blade, angled and biased thereagainst as to the scrape and discharge generally radially outwardly, any unwanted residue of the deposition process, permitting a clean upper surface of the receiving belt to be subsequently presented to the deposition station. A second arm arranged immediately adjacent the "downstream" side of the first arm is pivotably attached to the peripheral frame of the deposition machine and holds a felt liquid applicator which is in fluid communication through a conduit, with a reservoir containing a liquid release agent, application of which on the upper surface of the receiving belt serves to facilitate separation of the heated powder from the belt, after the heated (fused) powder has been pressed by a substrate at the join and cool station. A third arm, downstream of and adjacent to the second arm, and also pivotably attached to the peripheral frame of the deposition machine, carries a wiper blade to smooth and spread-out any puddles of release agent deposited by the second arm over the intermittently rotating belt. Each arm may be biased by a spring means between the respective arms and their bases on which they pivot on the peripheral frame of the machine, to ensure that their interface will be complete across the entire length of their respective member. Each arm has means at their proximal ends to hold them upright to facilitate servicing to themselves or to the receiving belt.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
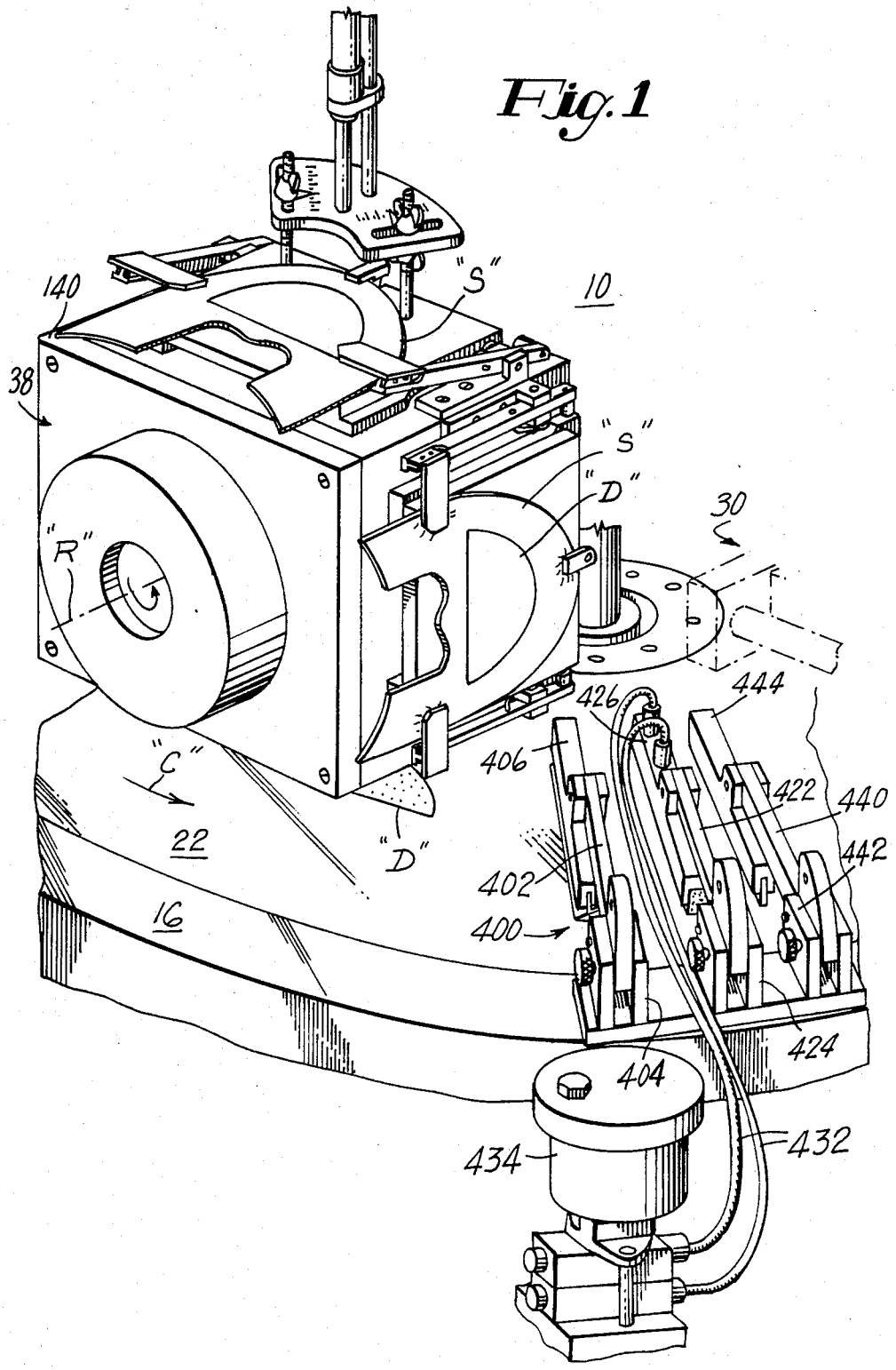
FIG. 1 is a perspective view of the conditioning mechanism attached to the powder deposition machine.

Referring now to the drawings in detail, and particularly to FIG. 1, there is shown a portion of a powder deposition machine 10 similar to that shown in U.S. patent application Ser. No. 451,919, filed Dec. 27, 1982 , now U.S. Pat. No. 4,480,581, and Ser. No. 452,963 filed Dec. 29, 1982 and assigned to the assignee of the present invention, and incorporated herein by reference.

An annular receiving surface or rotary belt 22, having an outer support ring 24, is horizontally rotatable about a hub, shown in the aforementioned application, the belt 22 rotatable in a counterclockwise direction, as shown by the arrow "C" in FIG. 1. The belt 22 is disposed within a middle frame portion 16, of the machine 10. The machine 10 also comprises a powder deposition station 30 and a join and cool station 38, only partially shown in FIG. 1 and described more completely in the aforementioned application.

The powder deposition station 30 comprises an arrangement for depositing a configuration of fusible powder from a hopper, not shown, onto the belt 22. The configuration of powder, "D", is then rotated on the belt through an array of heating elements, to fuse the powder, which fused configuration "D" is presented to the join and cool station 38, partially shown in FIG. 1, comprising a rotatable transfer means 140 which receives a substrate "S" and rotates it about an axis "R", to press it against the fused configuration of powder on the belt 22, between it and a cooling plate, as shown in the aforementioned applications. The configuration of fused powder is subsequently released from the belt 22 by the lifting of the substrate "S" and transfer means 140 therefrom, each rotating stepwise, for subsequent utilization.

Figure 2:
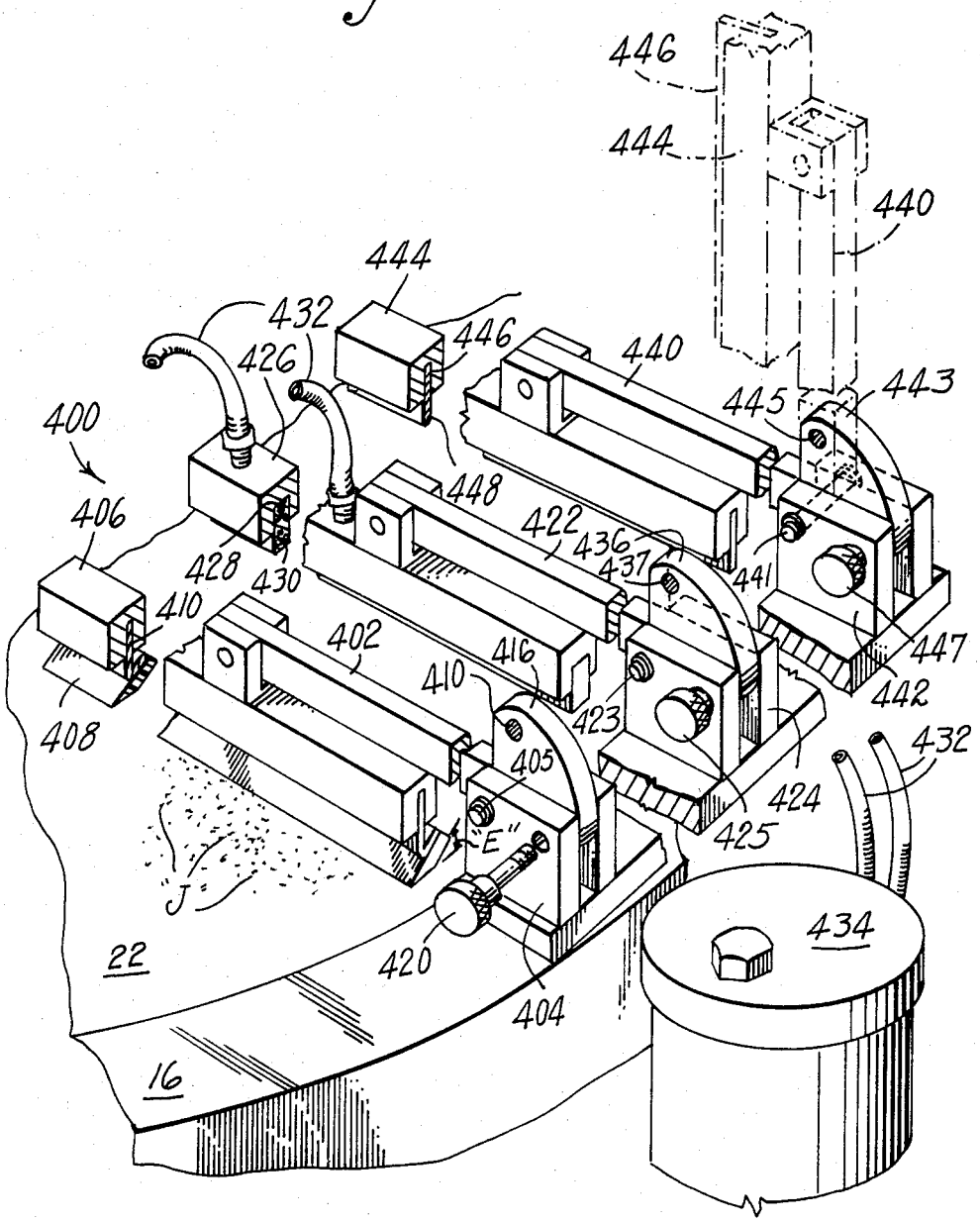
FIG. 2 is a closer perspective view of the arms of the conditioning mechanism.

The belt 22 rotatively advancing in a stepwise manner may contain a residue "J" of fused powder or the like thereon, which would contaminate successive configurations of unfused powder applied at the deposition station 30. Accordingly, a belt conditioning apparatus 400 is arranged so as to clean and prepare the surface of the annular belt 22 prior to its receiving subsequent depositions of powder. The belt conditioning apparatus 400 comprises a first arm 402 pivotably attached at one end thereof by an axis 405 to a pintle 404 secured to a portion of the middle frame 16. The other end of the first arm 402 is pivotably connected to an inverted channel 406. The channel 406 extends generally radially across the width of the annular belt 22, and has a blade 408 of polytetrafluroethylene material or the like arranged to be held in a slot 410 therein, as shown in FIG. 2. The blade 408 forms an acute angle "E" between the blade 408 and the belt 22, to scrape the debris off the belt as the belt 22 rotates. Disposition of the angularity of the first arm 402 from radiality with respect to the belt 22 to slight skewness therewith enables the residue to be swept outwardly off of the belt 22.

The proximal end of the first arm 402 pivotably attached to the pintle 404, has a tab portion 416 thereon, with an opening 410 therein, which is adapted to receive a locking pin 420 from the pintle 404, to lock the arm 402 after pivoting upwardly about its axis 405 into an upright position when it is necessary to change the blade 408 or work on the belt 22.

A second arm 422 may be pivotably arranged about a second axis 423 onto a second pintle 424 also secured to the middle frame 16. The second arm 422 is pivotably secured at its distal end to a second channel 426 which has an inverted slot 428, therein, which slot 428 carries a felt strip dispenser 430. The slot 428 is in fluid communication through a pair of flexible conduits 432, with a properly pressurized reservoir 434, shown in FIG. 1, which regulatably discharges a liquid release agent under pressure into the slot 428 and thus, to the felt strip 430 therein. The felt strip 430 is used to dispense a fluid release agent such as a polymeric organo siloxane fluid onto the belt 22 as the belt 22 rotates intermittently therebeneath. The second arm 422 has a tab portion 436 extending off of its proximal end and an opening 437 therein to receive a locking pin 425 in a manner similar to that of the first arm 402.

A third arm 440, of the conditioning apparatus 400 may be arranged adjacent the "downstream" side of the second arm 422, and is pivotably supported about an axis 441 on the middle frame 16 by a third pintle 442, as shown in FIG. 2. The distal end of the third arm 440 is pivotably attached to a third channel 444 which also, like the first and second channels 406 and 426, extend generally radially across the width of the annular belt 22. The third channel 444 has an inverted slot 446 therein, which has inserted therein a spreader blade 448, made from urethane or like plastic material. The third arm 440 has a tab portion 443 on its proximal end with an opening 445 to receive a third locking pin 447 to enable it to be pivoted about its axis 441 and locked into an upright position, as shown by the phantom lines in FIG. 2. The spreader blade 448 in the third arm 440 is the downstream-most entity in the belt conditioning apparatus 400. Since rotation of the annular belt 22 is intermittent, puddles of liquid release agent may build up from the discharge from the felt strip dispenser 430 of the second arm 422. The spreader blade 448 then acts as a squeegee to evenly disperse the release agent on the belt 22 as it advances.

Thus there has been shown a novel combination of conditioning apparatus useful for cleaning, and evenly applying a fluid agent to a rotating annular surface, which permits successive configurations of powder thereon to be applied with less chance of contamination and irregularities therein while also permitting an improved separation between the fused powder configuration and the belt 22 at the final station in the machine 10.

We claim:

1. A conditioning apparatus for an intermittently rotating annular webbed belt within a frame portion of a powder deposition machine having means thereon for applying a configuration of fusable powder to be heated and cooled and joined with a substrate, comprising:
   - a residue scraping means arranged over said annular belt;
   - a fluid applying means arranged over said belt adapted to apply a fluid thereon subsequent to scraping thereof; and
   - a fluid spreading means arranged over said belt to disperse an even distribution of fluid on said belt from said fluid applying means as said annular belt rotates; said scraping, applying and spreading means each being independently pivotable with respect to said belt for servicing thereof, and each scraping, applying and spreading means each also being independently lockable in an upright orientation to further facilitate servicing of said means or said belt.

2. A conditioning apparatus for a rotating annular belt as recited in claim 1, wherein said residue scraping means comprises an arm having a blade thereon to lift off residue from said belt as it rotates.

3. A conditioning apparatus for a rotating annular belt as recited in claim 2, wherein said fluid spreading means comprises an arm having a spreading blade thereon to evenly squeegee the fluid over the width of said annular belt.

4. A conditioning apparatus for a rotating annular belt, as recited in claim 1, wherein said fluid applying means comprises an arm having a dispersing member thereon to deposit a fluid on said belt as said belt rotates.

5. A conditioning apparatus for a rotating annular belt, as recited in claim 4, wherein said dispersing member comprises an elongated piece of felt in a slot in a channel pivotably attached to the distal end of said arm.

6. A conditioning apparatus for a rotating annular belt as recited in claim 4, wherein said dispersing member is in fluid communication with a fluid reservoir.

7. A conditioning apparatus for a rotating annular belt as recited in claim 6, wherein said reservoir contains a releasing agent.

* * * * *